US007066413B2

(12) United States Patent
Musso et al.

(10) Patent No.: US 7,066,413 B2
(45) Date of Patent: Jun. 27, 2006

(54) ELECTRIC HOPPER SPREADER

(75) Inventors: Charles S. Musso, Hammondsport, NY (US); Tom Musso, Bath, NY (US)

(73) Assignee: Air-Flo Manufacturing Co., Inc., Prattsburgh, NY (US)

( * ) Notice: Subject to any disclaimer, the term of this patent is extended or adjusted under 35 U.S.C. 154(b) by 163 days.

(21) Appl. No.: 10/729,792

(22) Filed: Dec. 5, 2003

(65) Prior Publication Data

US 2005/0121546 A1 Jun. 9, 2005

(51) Int. Cl.

| | |
|---|---|
| ***B05B 3/00*** | (2006.01) |
| ***A01C 19/00*** | (2006.01) |
| ***E01C 19/20*** | (2006.01) |
| ***A01G 27/00*** | (2006.01) |

(52) U.S. Cl. ..... 239/722; 239/677; 239/678; 239/679; 239/67; 239/68; 239/69

(58) Field of Classification Search ..... 239/722, 239/677, 678, 679, 650, 651, 668, 67–69
See application file for complete search history.

(56) References Cited

U.S. PATENT DOCUMENTS

| | | | | |
|---|---|---|---|---|
| 3,395,866 | A | 8/1968 | Sousek et al. | |
| 3,583,645 | A | 6/1971 | Murray | |
| 3,790,090 | A | 2/1974 | Lorenc et al. | |
| 3,871,588 | A | 3/1975 | Long et al. | |
| 3,929,292 | A | 12/1975 | Phillips | |
| 4,212,428 | A | 7/1980 | Walker | |
| 4,253,612 | A | 3/1981 | Schulze | |
| 4,373,668 | A | 2/1983 | Forbes et al. | |
| 4,662,511 | A * | 5/1987 | Greener | 198/834 |
| 5,947,391 | A | 9/1999 | Beck et al. | |
| 6,209,808 | B1 | 4/2001 | Anderson | |
| 6,220,531 | B1 | 4/2001 | Pierce et al. | |
| 6,220,532 | B1 * | 4/2001 | Manon et al. | 239/672 |
| 6,398,137 | B1 * | 6/2002 | Manon et al. | 239/672 |
| 6,517,281 | B1 | 2/2003 | Rissi | |
| 6,698,997 | B1 * | 3/2004 | Arne et al. | 414/502 |

* cited by examiner

*Primary Examiner*—Davis Hwu
(74) *Attorney, Agent, or Firm*—George R. McGuire; Bond, Schoeneck & King, PLLC

(57) ABSTRACT

A material spreading drive system for a hopper spreader having a conveyor and a spreader separately driven by two electric motors that are powered directly from the electrical system of the vehicle. The conveyor drive system includes a gearbox that transmits 90 to 95 percent of power received from the conveyor motor to the conveyor, thus reducing the demand on the electrical system. As a result, the electrical system is capable of also powering a second electric motor that drives the spreader. Due to the improved efficiency of the conveyor belt system, increased conveying and spreading speed are possible as well as independent control over the operating speeds of the conveyor and spreader.

6 Claims, 1 Drawing Sheet

ELECTRIC HOPPER SPREADER

BACKGROUND OF THE INVENTION

1. Field of Invention

The present invention relates to conveyor drive spreaders and, more specifically, to spreaders having a spinner and conveyor powered by separate motors.

2. Description of Prior Art

Conventional drive systems for a material spreading system on a vehicle, such as a hopper spreader, include an auxiliary source for powering both the conveyor drive system and the associated spreading spinner system. The auxiliary source may be a separate internal combustion engine, a hydraulic system with pump, valves and reservoir powered by the truck's engine, or an electric motor that is powered by the electrical system of the vehicle. Electrically powered spreaders are advantageous because they eliminate the need for a separate high maintenance auxiliary engine to power the spreader or the expense of attaching a separate hydraulic system to power the spreader hydraulically.

Conventional electrically powered spreaders were developed from engine-driven or truck-powered hydraulic spreaders. As auxiliary engine driven spreaders and hydraulically powered spreaders had an abundance of power, the low efficiency of the spreader's gear drive system did not affect the operational performance of these two types of spreaders. These spreaders could move the conveyor fast enough to spread effectively at faster speeds of up to 30 MPH that are required when operating this type of spreader.

When the electric spreader was developed, the low efficiency (30%) conveyor drive system of the hydraulic and engine drive spreaders resulted in a conveyor that ran very slow on the minimal amount of truck amperage that was available. The conveyor of the conventional electric spreader does not run fast enough to unload a sufficient amount of material at the higher speeds required in many spreading applications. These slow, electric spreaders are known as "walking speed" spreaders, and cannot be used in faster applications that a separate engine or hydraulic system powered spreaders can handle.

Another disadvantage of the conventional electric spreaders is that the single electric motor draws so much of the truck's amperage that it becomes impractical to power a separate electric motor to run the spinner disc. In hydraulically powered spreaders, independent control of conveyor and spinner was available gives the operator the flexibility in spreading operation to adjust to changing weather, traffic patterns or obstacles. Powering a second electric motor while the first motor is using most of the available amperage drains the battery system on the truck rather quickly. As a result, the conventional electric spreader is generally powered by just one electric motor, and thus is incapable of giving the user independent control over the conveyor and spinner disc.

3. Objects and Advantages

It is a principal object and advantage of the present invention to improve the speed of the conveyor and spreading systems of a electrically powered spreader.

It is an additional object and advantage of the present invention to provide conveyor and spreading systems for an electrically powered spreader that have independently controlled conveyors and spinners.

It is a further object and advantage of the present invention to provide a more efficient power transfer system in a hopper spreader.

Other objects and advantages of the present invention will in part be obvious, and in part appear hereinafter.

SUMMARY OF THE INVENTION

The present invention comprises a material spreading system for a truck comprising a conveyor and a spinner, each of which is powered by an electric motor that receives power from the vehicle's alternator/battery system. Since both electric motors are powered off the vehicle's battery there is limited amperage available for use by these motors. The conveyor drive system includes a high-efficiency gearbox or chain and sprocket system that translates about 90 to 95 percent of the power it receives into useful output, thus requiring less output from the power source (i.e., the battery) in order to provide predetermined levels of power of the conveyor than less efficient conveyor systems.

Due to the decreased power draw of the conveyor drive, the spinner can be fully powered by its own dedicated electric motor that also draws from the vehicle's battery. Thus, the drive system of the present invention permits faster conveyor and spreader speeds than could be achieved using prior art drive systems, and permits independent control of the spinner and conveyor for more precisely controlled spreading of the hopper contents.

DETAILED DESCRIPTION

Figure 1:
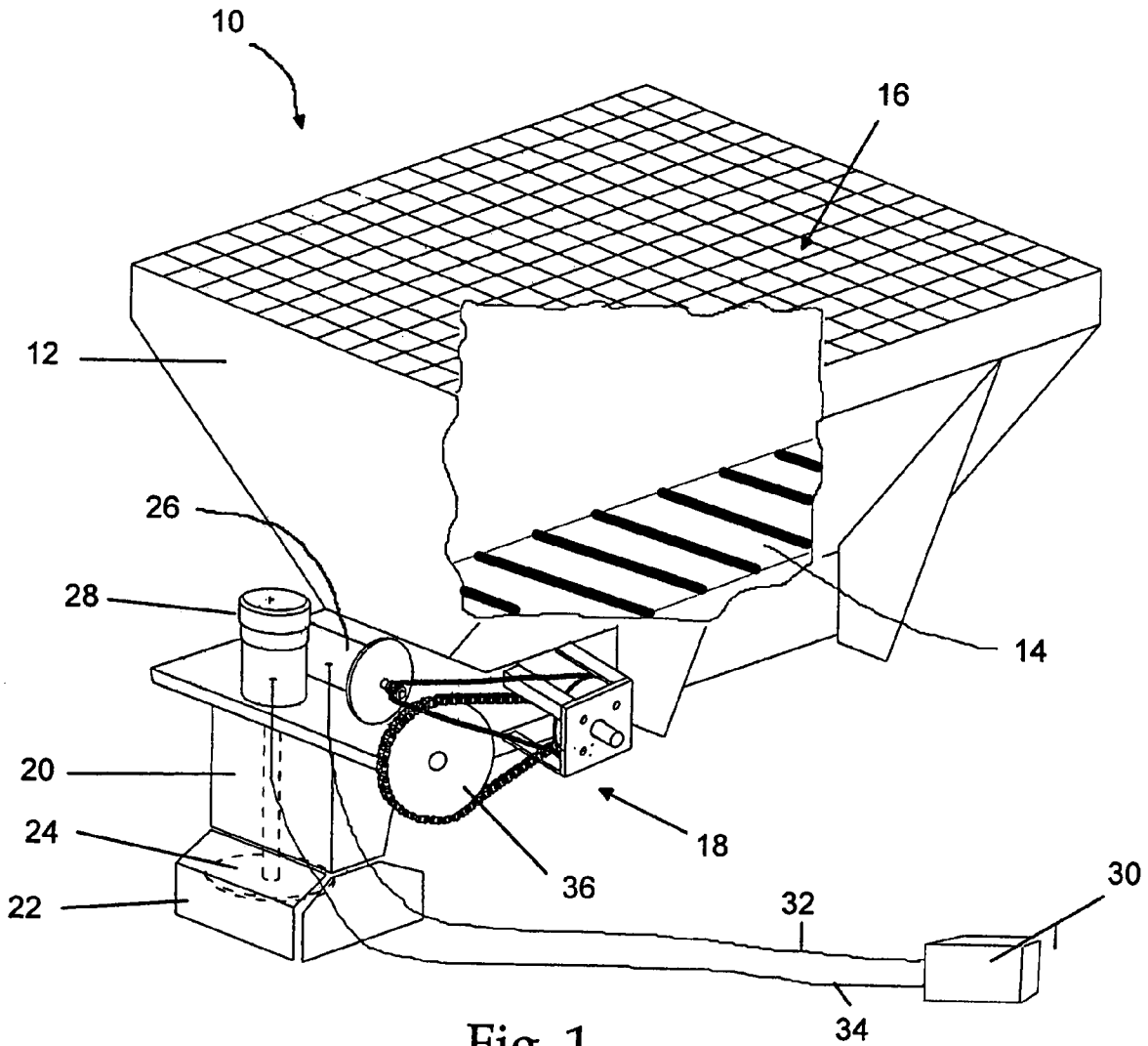
FIG. 1 is a perspective view of a hopper spreader according to the present invention.

Referring now to the FIGURE wherein like numerals refer to like parts throughout, there is seen in FIG. 1 a hopper spreader 10 according to the present invention that can be placed in the bed of a pick-up truck or similar vehicle and used to spread materials, such as road salt, rearwardly from the vehicle. Hopper spreader 10 comprises a hopper 12 having a conveyor 14, such as a conveyor chain or belt, positioned in the bottom of hopper cavity 16 and driven by a conveyor drive system 18, a vertical spreader housing 20 communicating with hopper 12 and having a skirt 22, a spinner 24 positioned inside skirt 22 of housing 20, and two separate electric motors, conveyor motor 26 and spinner motor 28, interconnected to conveyor drive system 18 and spinner 24, respectively. Conveyor motor 26 and spinner motor 28 are both powered by the electrical system of the vehicle 30 by leads 32 and 34, respectively.

Conveyor drive system 18 includes a chain and sprocket driver 36 for translating between about 90 and 95 percent of the power received from conveyor motor 26 into useful output, thus requiring less output from the vehicular electrical system (e.g., the battery). Alternatively, a similarly 90 to 95 percent efficient speed reducer, such as an eccentric cycloid disc speed reduction system available from Sumitomo Machinery Corporation of America, Chesapeake, Va. under the trade name SM-CYCLO®, may be used to translate power from conveyor motor 26 to the conveyor belt of hopper 12.

Due to the high efficiency of conveyor drive system 18, the ampere draw of conveyor motor 26 is significantly reduced, thereby enabling faster operating speeds. Because of the decrease in current required by conveyor motor 26, the vehicular electrical system also has sufficient current available to power separate spinner motor 28. As a result, conveyor motor 26 and spinner motor 28 can be controlled independently, thereby giving an operator more control over spreading speeds in variable conditions.

What is claimed is:

1. A spreading system for a vehicle having an electrical system, said system comprising:

a hopper;

a conveyor positioned within said hopper;

a first electric motor interconnected to said electrical system of said vehicle;

a high efficiency conveyor drive system comprising an eccentric cycloid disc speed reducer interconnected to said conveyor and coupled to said first electric motor;

a second electric motor interconnected to said electrical system of said vehicle;

a spreader communicating with said hopper and coupled to said second electric motor.

2. The spreading system of claim 1, wherein said high efficiency conveyor drive system translates between about 90 and 95 percent of the power received from said electric motor to said conveyor.

3. The spreading system of claim 1, wherein said conveyor drive system comprises a chain and sprocket driver.

4. The spreading system of claim 1, wherein said electrical system comprises a battery.

5. The spreading system of claim 1, wherein said spreader is a spinner disc.

6. The spreading system of claim 1, wherein said conveyor is a conveyor chain.

* * * * *